US005210371A

United States Patent [19]

Schneider et al.

[11] Patent Number: 5,210,371

[45] Date of Patent: May 11, 1993

[54] MODERN HYDRAULIC TURRET WEAPON SYSTEM

[76] Inventors: Wolf Schneider, Robbenweg 10, D-2300 Kiel 17, Fed. Rep. of Germany; Siegfried Harder, Moorweg 4, D-2334 Wolfskrug, Fed. Rep. of Germany; Klaus-Dieter Kahl, Landsteiner Strasse 8, D-6395 Weilrod 12, Fed. Rep. of Germany; Jean J. Schweitzer, 301 Lakeside, Brandon, Mich. 39042

[21] Appl. No.: 650,297

[22] Filed: Feb. 4, 1991

[30] Foreign Application Priority Data

Feb. 3, 1990 [DE] Fed. Rep. of Germany ..... 4003256

[51] Int. Cl.[5] ..... F41G 5/04

[52] U.S. Cl. ..... 89/41.12; 89/41.15

[58] Field of Search ..... 89/41.12, 41.15, 37.07, 89/37.09, 37.02, 37.17

[56] References Cited

U.S. PATENT DOCUMENTS

| | | | |
|---|---|---|---|
| 2,304,566 | 12/1942 | Haberlin | 89/37.17 |
| 2,528,645 | 11/1950 | Edwards | 89/41.12 |
| 2,948,193 | 8/1960 | Leathers et al. | 89/41.12 |
| 4,020,407 | 4/1977 | Clement et al. | 318/632 |
| 4,047,467 | 9/1977 | Lundin | 180/6.48 |
| 4,573,397 | 3/1986 | LeBlanc et al. | 89/41.12 |

FOREIGN PATENT DOCUMENTS

| | | | |
|---|---|---|---|
| 908823 | 3/1954 | Fed. Rep. of Germany | 89/41.12 |
| 2113144 | 9/1972 | Fed. Rep. of Germany | 89/41.12 |
| 1068005 | 6/1954 | France | 89/41.12 |
| 476590 | 12/1937 | United Kingdom | 89/41.12 |

*Primary Examiner*—Stephen M. Johnson

*Attorney, Agent, or Firm*—Barnes, Kisselle, Raisch, Choate, Whittemore & Hulbert

[57] ABSTRACT

A hydraulic turret weapon system for armed vehicles that includes a turret and a weapon on the turret adapted to be independently directed at a target. A hydraulic drive includes a pair of hydraulic motors for moving the turret and weapon respectively. The motors are connected in parallel with each other to a pressure compensated pump and to a fluid reservoir. A pair of pressure sensors are respectively connected to the inlets and outlets of the parallel motors, and provide electrical signals as a function of hydraulic fluid pressure. An electronic controller is responsive to the pressure sensor signals, and to turret and weapon command signals, for generating directive signals to control motion at the turret and weapon motors individually. Velocities at the hydraulic motors are controllable both independently and conjointly.

6 Claims, 3 Drawing Sheets

MODERN HYDRAULIC TURRET WEAPON SYSTEM

This invention applies to turret weapon drive systems, especially to the main weapon of tanks, which quickly follow a target and/or have to be stabilized.

BACKGROUND OF THE INVENTION

To date, these kind of weapon drive systems normally have hydraulic motors operating at constant displacement for the mass (turret) to be directed in transverse direction and hydraulic actuators with big volumes for the mass (weapon) to be elevated, while the turret adjustment is controlled by servo valves which obtain their hydraulic power from hydraulic pumps and accumulators. They are kept pressurized by an intermittent working pump.

Under certain circumstances these weapon drive systems can be dangerous for the tank crew, especially when the pressure reservoir is being damaged under bombardment.

Most of all, these weapon drive systems have a very poor efficiency, because the volumetric flow is controlled by servo valves. The resulting differential pressure leads to a significant oil temperature increase. Due to this, an additional heat exchanger is necessary.

Since the sectional area of the cylinders has to be quite large due to mechanical stiffness of motion, the system pressure cannot be freely selected. The only result of increased system pressure would be increased pressure losses at the servovalves.

In order to eliminate at least part of these disadvantages, electrical drive systems have been developed. These electrical systems are not as efficient as hydraulic systems (less power density), are too big and too heavy, and are unable to fullfil the requirements of gun laying speed and acceleration needed for heavy weapons.

SUMMARY OF THE INVENTION

The main point of this invention is the improvement of the hydraulic drive system by using hydraulically driven motors for elevating and traversing mass/-material.

Without any performance loss, it is possible to eliminate large hydraulic accumulators and the deviation actuator for the transverse drive. Furthermore, the problem of the hydraulic actuator's stiffness can be avoided. The control gain has no compressable oil volumes. In addition, it is possible to increase the system pressure without resulting in higher pressure losses, i.e. the efficiency can be significantly improved. The large servo valves located in the main oil flow, where high temperature losses occur, are avoidable.

The hydraulic turret drive system can be dynamically improved if the directive signal for the overcenter motors is in addition influenced by the pressure occuring on both sides of the hydraulic motors, i.e. cavitation at the inlet and pressure reduction at the outlet do not sink below a desirable low level. In this respect a combination of the elevation and transverse circuit is advantageous, so that fluid lack in the one circuit can be compensated by the fluid in excess in the other circuit and vice versa. This is possible, especially when both motors are hydraulically connected in parallel. In this case, it is sufficient to use only two pressure sensors. The compensation between the elevation and transverse circuit will be done automatically.

The hydraulic pump may also function as a pressure compensated pump, and can be operated by either the main power supply of the system (i.e., the vehicle engine), or by an auxiliary power supply system. This means on the one hand, an improvement of the power efficiency since the transformation into electrical energy and the recuperation of hydraulic energy —the way it normally is done in today's tanks—can be avoided. On the other hand, the pump can be moved into neutral position without any hydraulic power consumption as long as there are not turret movements. This applies especially when the nominal value of the pressure is adjusted to minimum value.

A further step is the use of a reversing pump. This pump is able to transform part of the braking energy—occuring in the turret drive system—back into mechanical energy—routing this energy back to the engine.

Hydraulic motors may be employed for the elevation adjustment despite normally used elevation cylinder. This cylinder is replaced by a ballscrew spindle with a nut which is driven by a hydraulic motor—possibly by using a gear box. This solution offers the advantage of significantly increased ridigity of the elevation drive in comparison to the hydraulic actuators, avoiding the natural frequency of the weapon, which has a disturbing effect on the gun laying.

It is advantageous to use additional brakes in line with the elevation and transverse motor. On the one hand they lock/shut down the turret drive system when the pressure of the hydraulic motors is too low. On the other hand, the brakes are able to absorb braking energy while the system is slowed down and the hydraulic motors function as pumps.

DETAILED DESCRIPTION OF PREFERRED EMBODIMENTS

Figure 1:
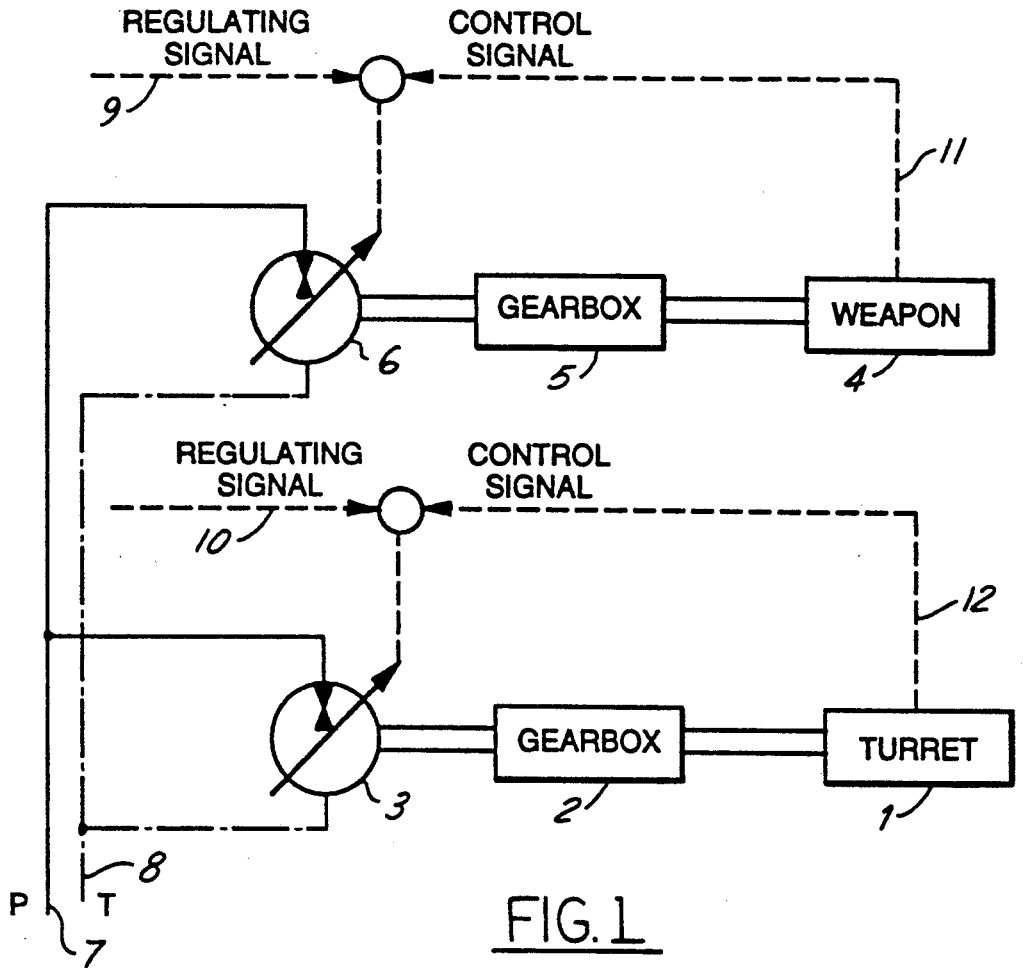
FIGS. 1 and 2 show the schematic of the turret drive system according to this invention.
Figure 4:
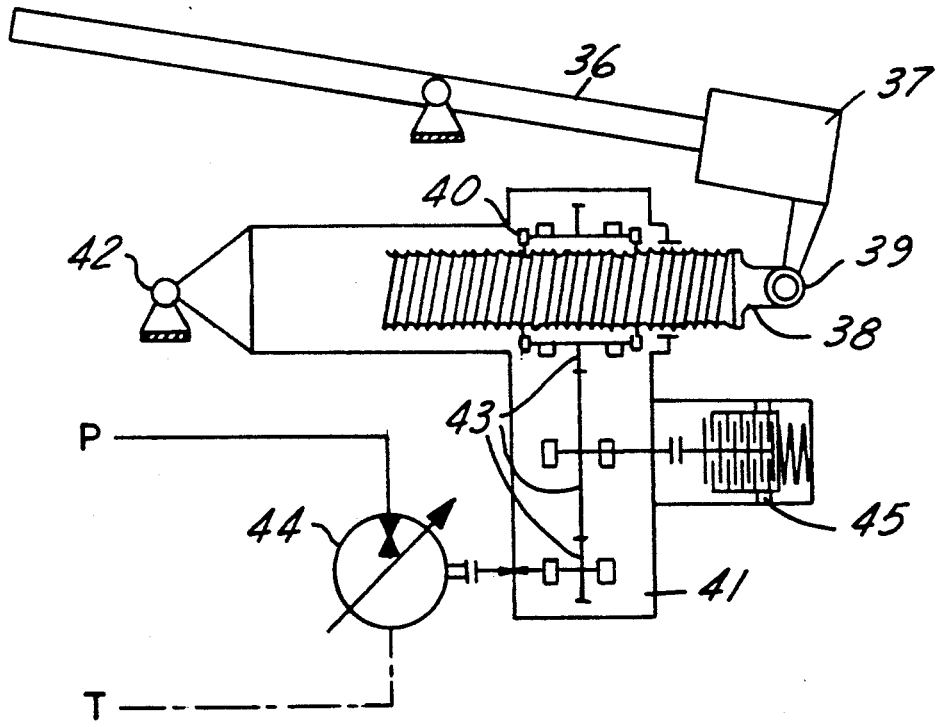
FIG. 4 schematically shows an elevation motor in accordance to the invention.

The schematic FIG. 1 shows the essential assemblies of a turret drive system, i.e. the mass/material to be directed in traverse direction (turret), driven by a hydraulic motor 3 in accordance with the invention via a traverse gear box 2. Furthermore, the FIG. shows the mass/material 4 (weapon) to be elevated, driven by hydraulic motor 6 via a gear box. The gear box 5 could—for example—be a spindle drive in accordance with the invention as shown in FIG. 4—to be described later.

The hydraulic motors 3, 6 are connected to a hydraulic system via pressure pipe line 7 and reservoir pipe line 8. The hydraulic motors 3, 6 can be driven in both directions and their speed is infinitely variable between maximum and minimum r.p.m. The regulating signal 9, 10 in comparison to control (guidance) signal 11, 12 is originated at an electrical fire-control system —not shown in this schematic.

Figure 2:
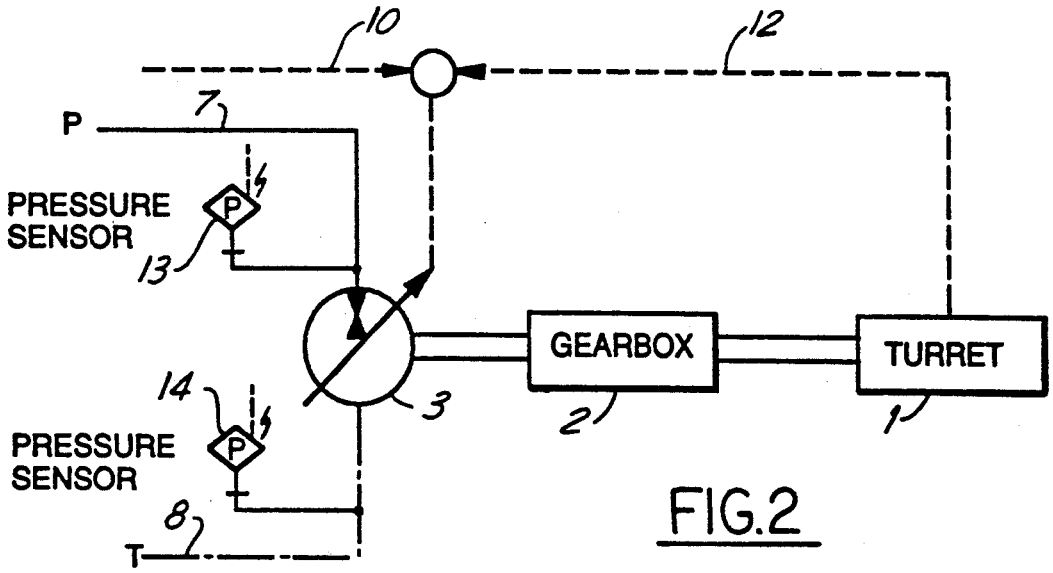

FIG. 2 shows a turret drive system in accordance with FIG. 1 with mass 1, mechanical gear box 2 and hydraulic motor 3. A pressure sensor 13 is connected to pressure pipe line 7 and a pressure sensor 14 is connected to reservoir pipe line 8. The pressure sensing signals are processed in an electronic system not shown in this schematic. It functions as follows: The hydraulic motor on the delivery/pressure side does not obtain more fluid than provided by the supply pump. (The pressure in pipe line 7 may not drop below a certain minimum value.)

According to the above-mentioned, the hydraulic motor is driven in that way, that the pressure in reservoir pipe line 8 also does not drop below a certain minimum pressure level. It is especially important to avoid cavitation. The pressure signal of sensor 13 leads to limitation of the acceleration phase, the pressure signal of sensor 14 leads to limited deceleration phase.

Figure 3:
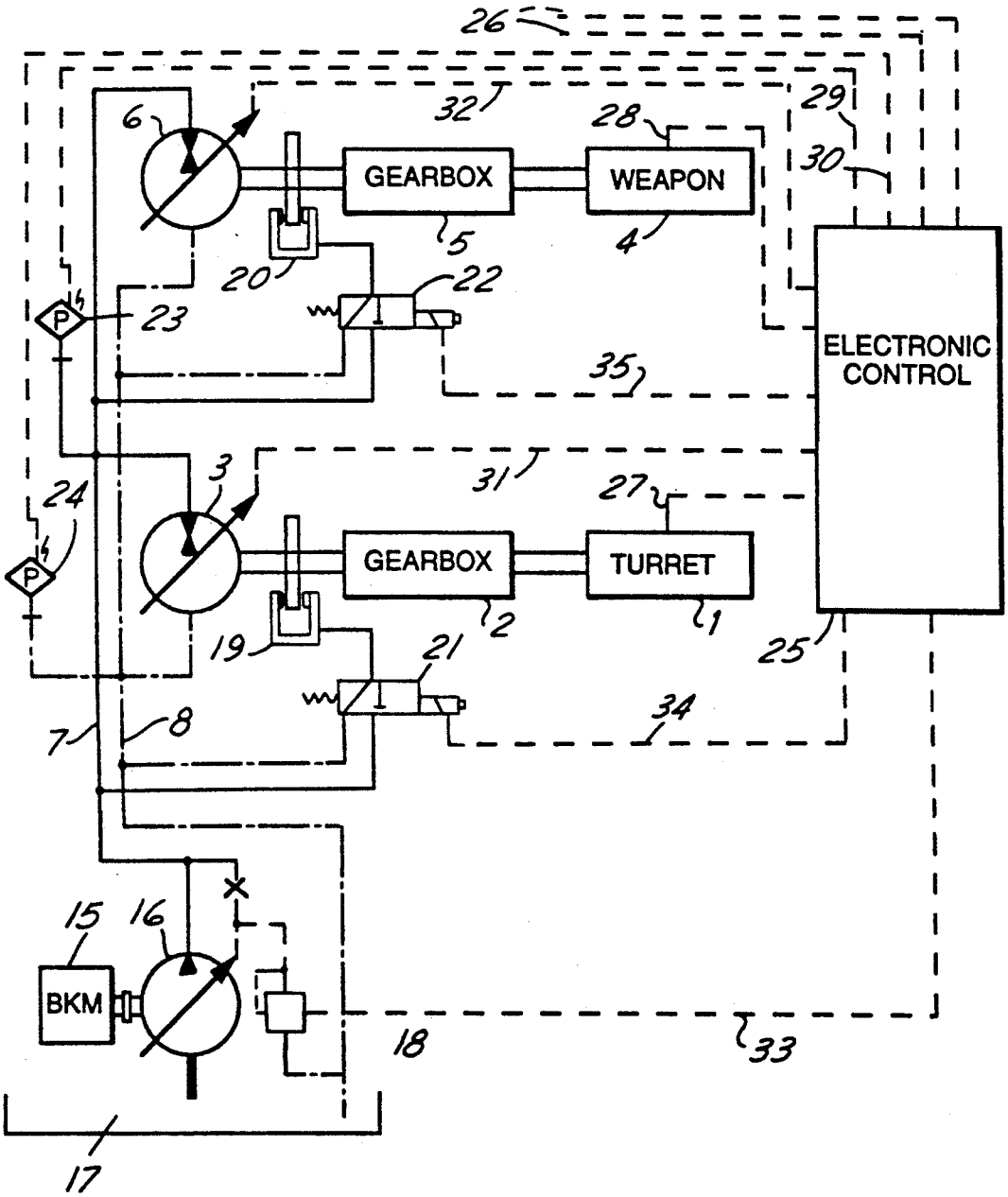
FIG. 3 shows another schematic of the system function.

FIG. 3 schematically shows the complete turret drive system of a tank vehicle. Engine 15 of the turret drive system operates hydraulic pump 16. This pump may be a pump with constant displacement, but can also be—as shown in FIG. 3 —working at variable displacement. The pump sucks hydraulic fluid from reservoir 17 which preferably should be a "closed" version—slightly pressurized. It is clear from this schematic that the hydraulic turret drive system does not contain any accumulators or cylinders which absorb or supply larger quantities of fluid. By this means it is possible to operate the system with a small reservoir. The quantity of fluid in the hydraulic system/circuit practically always remains constant. Most preferably, pump 16 comprises a reversible pump adapted to feed fluid to reservoir 17 without changing direction of rotation as driven by engine 15.

Furthermore, the schematic shows the control system 18 for pressure control pump 16 with which it is possible to change the pressure in pressure pipe line 7 according to the requirements, for example, while a target is only observed (silent watch), providing the positive consequences of energy saving and reduction of noise level. Besides this, the pressure control system is used to switch pump 16 to depressurized mode, used when the tank is driven with locked turret drive system.

This locking can be achieved by brakes 19, 20 located at the gear shafts between the hydraulic motors 3, 6 and the mass 1 to be directed.

These brakes are controlled by pilot valves 21, 22. This is done in such a way that they are closed in an unpressurized condition and opened by increase of pressure in pipe line 7. Besides obtaining a safety device (depressurized —braked), it is in addition possible to control the brakes with the existing pressure in pipe line 7, for example, in order to support the deceleration process of the mass to be directed.

Pressure sensors 23, 24 are located in pipe lines 7, 8 in such a way that they commonly control the pressure level of hydraulic motors 3, 6. The whole turret drive system is controlled via an electronic control device 25, which converts fire control signals 26 for elevation and traverse movements with system internal signals, such as the signals from pressure sensors 29, 30, and which provides control (command) signals 31, 32 for the hydraulic motors, as well as control (command) signal 33 for the pressure regulating pumps 34, 35 for brake control unit 21, 22.

FIG. 4 shows an elevation drive together with a schematically drawn weapon 36. Tightened to weapon lock 37, a screwed spindle 38 is linked via flexible link 39. Spindle nut 40 is located in gear box 41 which is supported in the turret via line 42. If nut 40 is turned, the distance between links 39, 42 is changeable—working like an elevation cylinder. Nut 40 is driven by hydraulic motor 44 via gears 43 located in gear box 41. Brake 45 is also located in gear box 41 and is used —as already described—to lock the weapon respectively to support the deceleration phase of the hydraulic motor during tracking movement.

We claim:

1. A hydraulic turret weapon system for armed vehicles that includes:

a turret and a weapon on said turret adapted to be independently directed at a target as a function of directive signals, hydraulic drive means including a pair of hydraulic motors, means coupling one of said motors for moving said turret, means coupling the other of said motors for moving said weapon, means connecting inlets of said motors in parallel to a source of fluid under pressure, and means connecting outlets of said motors in parallel to a fluid reservoir, a pair of pressure sensors, one of said sensors being connected to said inlets for providing an electrical signal as a function of hydraulic fluid pressure at said inlets, the other said pressure sensor being connected to said outlets to provide an electrical signal as a function of hydraulic fluid pressure at said outlets, and electronic control means responsive to said pressure sensor signals and to turret and weapon command signals for generating said directive signals, including means for controlling speed of said motors individually, and means coupled to said fluid source for controlling speed of said motors conjointly.

2. The system set forth in claim 1 wherein said source of fluid under pressure comprises a pressure compensated pump.

3. The system set forth in claim 2 wherein said means for controlling said speed of said motors conjointly comprises means responsive to said electronic control means for adjusting displacement of said pump.

4. The system set forth in claim 3 wherein said pump comprises a reversible pump adapted to feed fluid to said reservoir without changing direction of rotation.

5. The system set forth in claim 1 wherein said hydraulic drive means further includes a linear actuator comprising a spindle with a nut threaded thereon, one of said spindle and nut being coupled to one of said motors, and the other of said spindle and nut being coupled to one of said turret and said weapon.

6. The system set forth in claim 1 further comprising hydraulic brake means coupled to said motors for arresting motion at said turret and weapon in the event of hydraulic fluid pressure failure.

* * * * *